US010045595B2

(12) United States Patent
Vaccaro et al.

(10) Patent No.: US 10,045,595 B2
(45) Date of Patent: Aug. 14, 2018

(54) QUICK DISCONNECT COUPLING

(71) Applicant: Safariland, LLC, Jacksonville, FL (US)

(72) Inventors: Dylan K. Vaccaro, Jacksonville, FL (US); William H. Rogers, St. Augustine, FL (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 15/408,628

(22) Filed: Jan. 18, 2017

(65) Prior Publication Data

US 2017/0215527 A1 Aug. 3, 2017

Related U.S. Application Data

(60) Provisional application No. 62/280,601, filed on Jan. 19, 2016.

(51) Int. Cl.
*A44B 17/00* (2006.01)

(52) U.S. Cl.
CPC ..... *A44B 17/0047* (2013.01); *A44B 17/007* (2013.01)

(58) Field of Classification Search
CPC ..... A44B 17/0047; A44B 17/007; Y10T 24/4086; Y10T 24/3405; Y10T 24/3408;
(Continued)

(56) References Cited

U.S. PATENT DOCUMENTS 1,920,408 A * 8/1933 Lafayette ..... B64D 17/30 24/654
2,956,324 A 10/1960 Klein
(Continued)

FOREIGN PATENT DOCUMENTS

| | | | |
|---|---|---|---|
| GB | 2079359 | A | 1/1982 |
| WO | 2011146718 | A1 | 11/2011 |
| WO | 2013109587 | A1 | 7/2013 |

OTHER PUBLICATIONS

PCT Application No. PCT/US2017/013857—PCT Search Report and Written Opinion dated Apr. 5, 2017.

*Primary Examiner* — Robert Sandy
*Assistant Examiner* — Rowland Do
(74) *Attorney, Agent, or Firm* — Kane Kessler, P.C.; Paul E. Szabo

(57) ABSTRACT

A quick disconnect coupling for releasably connecting first and second garment parts includes a tubular outer coupling part having a central opening and a garment portion that is configured to be connected with the first garment part. An inner coupling part has a garment portion that is configured to be connected with the second garment part. The inner coupling part is selectively movable into and out of the central opening of the outer coupling part to releasably connect the first and second garment parts. The coupling further includes a release pin that is movable along a pin passage in the inner coupling part to change the configuration of the inner coupling part from a locking configuration in which the inner coupling part is locked to the outer coupling part, to an unlocked configuration in which the inner coupling part can be pulled out of the central opening of the outer coupling part thereby to disconnect the coupling.

11 Claims, 4 Drawing Sheets

(58) Field of Classification Search
CPC . B64D 17/30; B64D 17/32; F16B 2/18; F16B 7/1418; F16B 7/1427; F16B 7/1454; F16B 19/1081; F16B 13/066; E21D 21/008
See application file for complete search history.

(56) References Cited

U.S. PATENT DOCUMENTS

| | | | | |
|---|---|---|---|---|
| 3,283,336 | A | 11/1966 | Critser | |
| 3,421,404 | A * | 1/1969 | Jacobs | F16B 13/066 411/55 |
| 3,739,684 | A * | 6/1973 | Vitkevich | F16B 13/124 411/49 |
| 4,648,161 | A | 3/1987 | Rosen | |
| 4,935,996 | A | 6/1990 | Ferrara | |
| 5,410,784 | A | 5/1995 | Katz | |
| 5,671,516 | A | 9/1997 | Sartori | |
| 7,047,570 | B2 | 5/2006 | Johnson | |
| 7,979,917 | B2 | 7/2011 | Osborne | |
| 7,987,523 | B2 | 8/2011 | Cole et al. | |
| 8,056,196 | B2 | 11/2011 | Sample et al. | |
| 8,776,275 | B2 | 7/2014 | Kordecki | |
| 8,814,020 | B2 | 8/2014 | Yaeger et al. | |
| 8,973,169 | B2 | 3/2015 | Curtis et al. | |
| 2005/0091802 | A1 * | 5/2005 | Koike | B62D 27/02 24/297 |
| 2013/0071201 | A1 * | 3/2013 | Watanabe | F16B 19/1081 411/80.1 |
| 2014/0196203 | A1 | 7/2014 | Cole et al. | |
| 2014/0332572 | A1 | 11/2014 | Buerck et al. | |
| 2015/0211829 | A1 | 7/2015 | Cole et al. | |

* cited by examiner

QUICK DISCONNECT COUPLING

BACKGROUND OF THE INVENTION

This application relates to a quick disconnect coupling. The coupling may be used on a garment, for example, a garment worn by a law enforcement officer or a soldier which must be capable of being removed almost instantly in an emergency situation. One such type of garment is often called a "quick disconnect vest", as one example.

DETAILED DESCRIPTION

Figure 1:
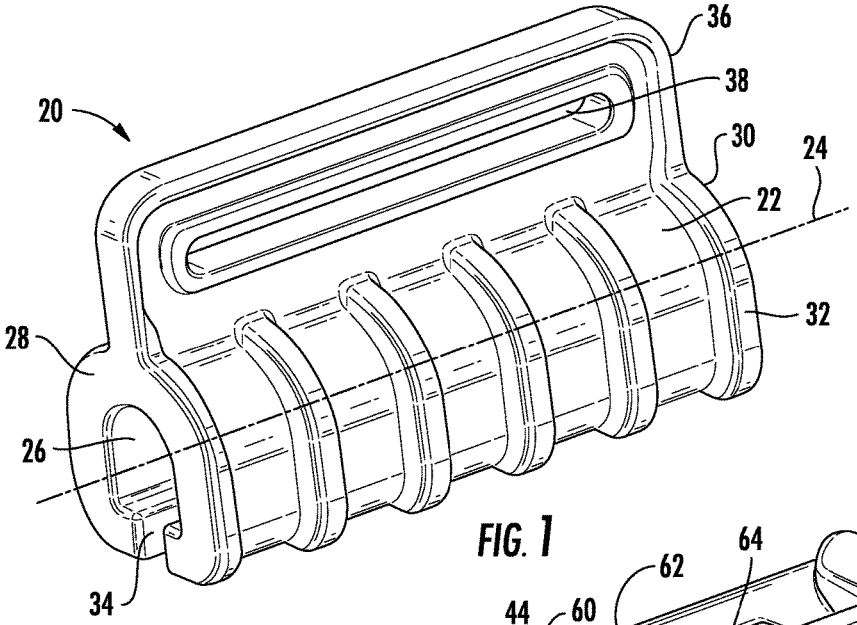
FIG. 1 is a perspective view of an outer coupling part that is one part of a coupling that is a first embodiment of the invention.
Figure 2:
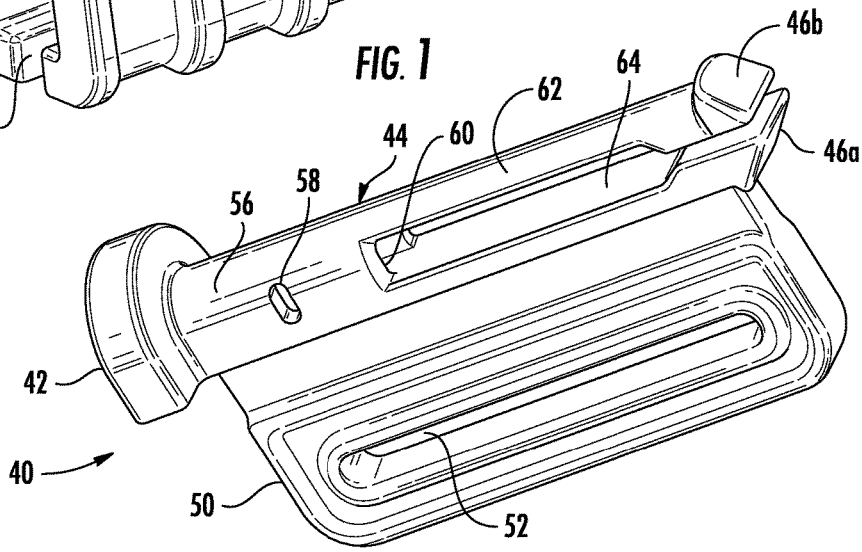
FIG. 2 is a perspective view of an inner coupling part that is another part of a coupling that is a first embodiment of the invention.
Figure 3:
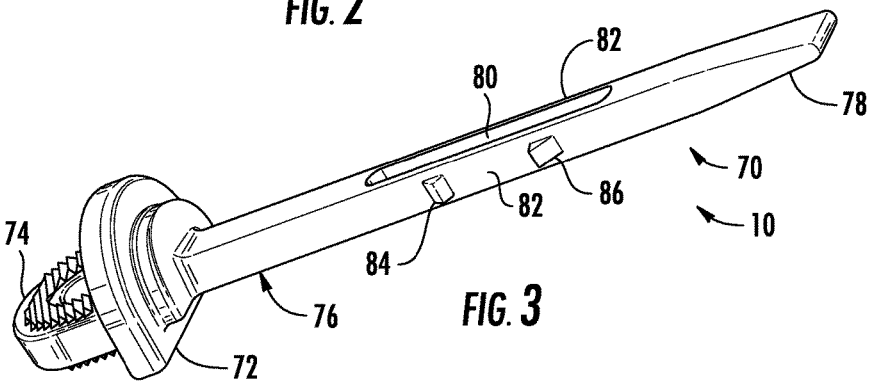
FIG. 3 is a perspective view of a release pin that is yet another part of a coupling that is a first embodiment of the invention.

The present invention relates to a quick disconnect coupling. The invention is applicable to various types of couplings, including but not limited to couplings that can be used in garments, for example. FIGS. 1-8 illustrate a quick disconnect coupling 10 that is a first embodiment of the invention. The coupling is shown connected between two garment parts illustrated schematically at 12 and 14 as being straps or portions of belt webbing. A coupling of the present invention may be used to connect other garment parts, of course.

The coupling 10 includes three pieces—an outer coupling part 20, an inner coupling part 40, and a release pin 70, each described below in detail. As described below, the inner coupling part 40 is fitted within the outer coupling part 20, and the release pin is selectively movable within the inner coupling part 40 to lock and unlock the inner coupling part 40 and the outer coupling part 20.

The outer coupling part 20 (FIG. 1) has a generally tubular configuration defined by a side wall 22 centered on a longitudinal axis 24 of the coupling. A D-shaped central opening 26 extends longitudinally between first and second end surfaces 28 and 30 of the side wall. Ribs 32 are provided on the outer side surface of the side wall 22 for strength and to enhance the ability of the user to grip the outer coupling part 20.

A longitudinal first slot 34 extends the length of the side wall 22, on the flat side of the D-shaped central opening 26, providing a radial opening into the central opening. Opposite the first slot 34, a garment tab 36 projects radially outward from the side wall, and has a first garment slot 38 for receiving the first garment part 12.

The inner coupling part 40 (FIG. 2) is substantially the same length as the outer coupling part 20. The inner coupling part 40 has a D-shaped first end flange 42. A fixed arm portion 44 of the inner coupling part 40 extends from the flange 42 and terminates in a first barb 46*a* that is disposed at the second end 48 of the inner coupling part 40. The fixed arm portion 44 includes a garment tab 50 that projects radially outward and that has a second garment slot 52 for receiving the second garment part 14.

The fixed arm portion 44 of the inner coupling part 40 includes a tubular wall segment 56 adjacent the flange 42, which extends from the flange for about a third of the length of the fixed arm portion. The tubular wall segment 56 has two detent openings 58 on opposite sides, and an end surface 60. A flexible arm 62 extends from the end surface 60, opposite the garment tab 50, and terminates in a second barb 46*b* adjacent to the first barb 46*a*. A pin passage 64 is thereby defined between the flexible arm 62 and the fixed arm portion 44. The flexible arm 62 is bendable about its inner end to move the second barb 46*b* closer to and farther from the first barb 46*a*, thus varying the width of the pin passage 64.

The release pin 70 (FIG. 3), which is the third part of the coupling, is normally engaged with the inner coupling part 40 and is selectively movable relative to the inner coupling part 40. At its first end portion, the release pin 70 includes a D-shaped flange 72, and on one side of the flange there is a manually engageable pull tab 74. A body portion 76 of the release pin 70 extends from the flange 72 in a direction away from the pull tab 74. The body portion 76 of the release pin 70 has an elongate flat configuration, like a toothpick, with a tapered end portion 78.

A detent slot 80 extends for about half the length of the body portion 76 of the release pin 70, thus creating two bendable wall portions 82 on opposite sides of the detent slot. On each bendable wall portion 82 are located two detent teeth: a pair of first detent teeth 84 are closer to the flange 72, and a pair of second detent teeth 86 are closer to the tapered outer end portion 78 of the release pin 70.

As noted above, the release pin 70 is normally engaged with the inner coupling part 40 (FIGS. 4 and 5) and is selectively movable relative to the inner coupling part 40. Specifically, the body portion 76 of the release pin 70 is inserted into the inner coupling part 40, with the tapered end portion 78 entering through the flange 42 (in a direction generally to the right as viewed in the Figures). The body portion 76 of the release pin 70 moves along the length of the inner coupling part 40 until the body portion enters into the pin passage 64 of the inner coupling part. The second detent teeth 86 move past the end surface 60 of the tubular wall segment 56 of the inner coupling part 40, into the pin passage 64. Further movement in this same direction causes the first detent teeth 84 to also move past the end surface 60 of the tubular wall segment 56 and into the pin passage 64.

Figure 5:
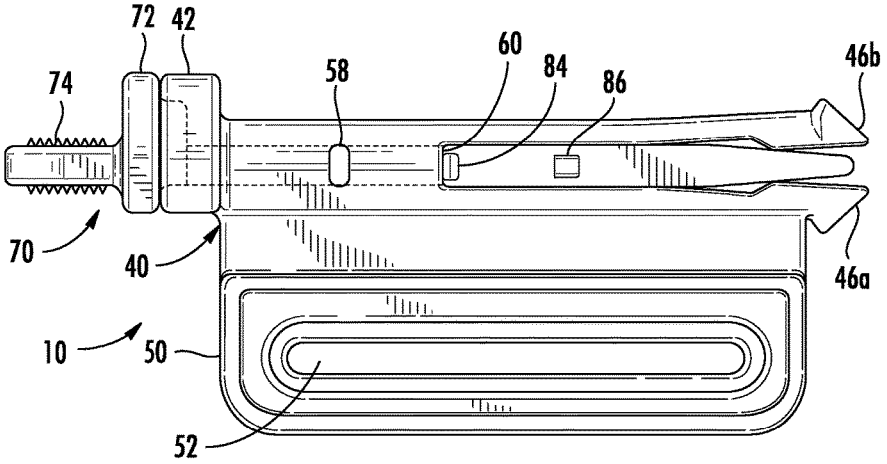
FIG. 5 is a view similar to FIG. 4 and showing the release pin and inner coupling part in a locked condition.

The release pin 70 is thus selectively movable between two detent positions relative to the inner coupling part 40. In the first detent position, or locked position, as shown in FIG. 5, both pairs of detent teeth 84 and 86 are located in the pin passage 64 of the inner coupling part 40. The first detent teeth 84 are at the location of the end surface 60 of the tubular wall segment 56 of the inner coupling part 40. The engagement of the first detent teeth 84 with the end surface 60 resists movement of the release pin 70 back out of the pin passage 64, that is, in a direction generally to the left as viewed in the Figures.

When the parts are in this locked position, the outer end portion 78 of the release pin 70 is located between the two barbs 46*a* and 46*b* on the inner coupling part 40. This positioning of the release pin 70 prevents the movable barb 46*b* on the flexible arm 62 of the inner coupling part 40 from moving toward and/of into engagement with the fixed barb 46*a* of the inner coupling part 40.

Figure 4:
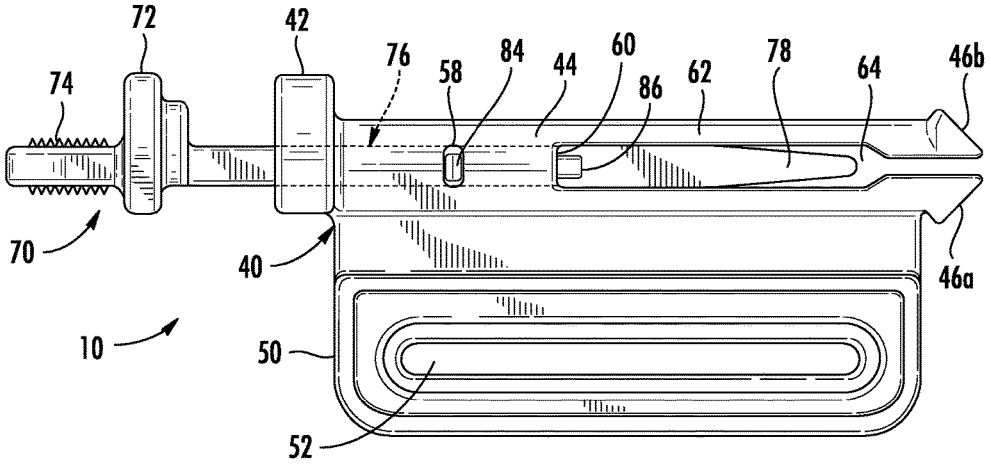
FIG. 4 is a side elevational view of the release pin and inner coupling part in an unlocked condition.

In the second or unlocked position of the release pin 70 relative to the inner coupling part 40, as illustrated in FIG. 4, only the second pair of detent teeth 86 are located, in the pin passage 64 of the inner coupling part 40, at the location of the end surface 60 of the tubular wall segment 56.

The first detent teeth 84 are located in the detent openings 58 in the tubular wall segment 56 of the inner coupling part 40. The engagement of the first detent teeth 84 with the inner coupling part 40, and even more the engagement of the detent teeth 86 with the end surfaced 60, resists movement of the release pin 70 farther back out of the inner coupling part 40, that is, in a direction generally to the left as viewed in the Figures. This feature enables the assembled release pin 70 and inner coupling part 40 to be pulled out together from the outer coupling part 20, when the entire coupling 10 is being disconnected as described below.

When the parts in this unlocked position (FIG. 4), the tapered outer end portion 78 of the release pin 70 is not located between the two barbs 46*a* and 46*b* of the inner coupling part 40. This particular positioning of the release pin 70 allows the movable barb 46*b* on the flexible arm 62 of the inner coupling part 40 to be moved toward the fixed barb 46A on the inner coupling part.

During longitudinal movement of the release pin 70 relative to the inner coupling part 40 as thus described, the first detent teeth 84 need to move radially inward. Such radially inward movement is facilitated by the positioning of the detent teeth 84 on the bendable wall portions 82 of the release pin 70. Thus, as the release pin 70 is pulled from the locked position to the unlocked position, the bendable wall portions 82 bend inward to allow the first pair of detent teeth 84 to move past the end surface 60 of the inner coupling part 40, toward and to the detent openings 58, at which point the first detent teeth move radially outward again.

These two positions of the release pin 70 in the inner coupling part 40, locked and unlocked, come into play when the inner coupling part 40 is assembled with the outer coupling part 20, as described next.

Specifically, the release pin 70 is permanently engaged with the inner coupling part 40, during normal usage of the coupling. To commence assembly of the coupling, the release pin 70 is pulled outward relative to the inner coupling part 40, to the unlocked position (FIG. 4). This movement withdraws the end portion 76 of the release pin 70 from between the two barbs 46*a* and 46*b*, allowing the movable barb to be moved inward toward the fixed barb. When the coupling 10 is being unlocked, the detent teeth 86 engage the end surface 60, thus keeping parts 40 and 70 together and allowing one to pull the coupled inner part and release pin part way out of the outer coupling part, with one motion.

Figure 6:
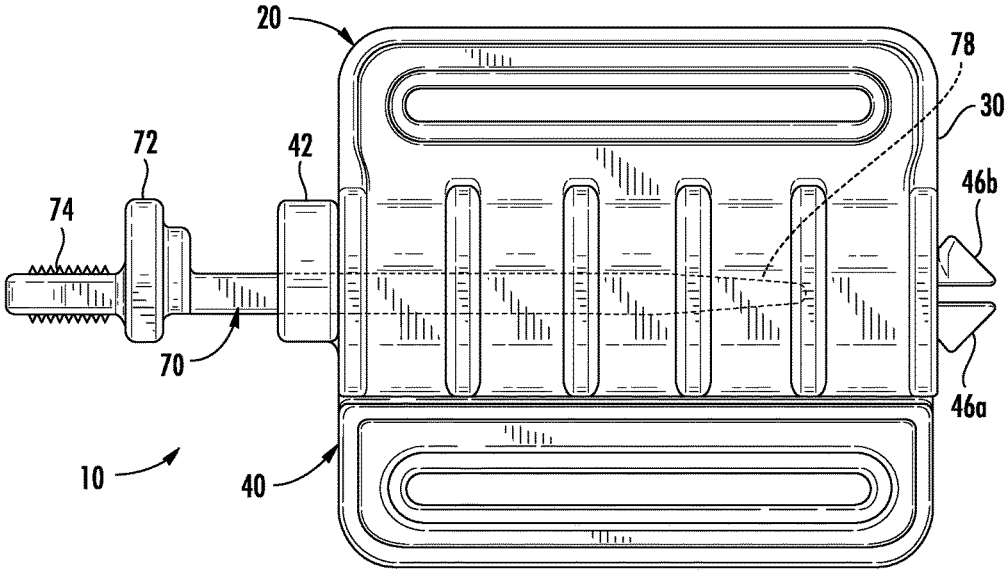
FIG. 6 is a side elevational view of the entire coupling shown in an unlocked condition.

The second end of the inner coupling part 40 is then inserted into the central opening 26 in the outer coupling part 20 (to the right as viewed in FIG. 6). As this movement occurs, the movable barb 46*b* on the flexible arm 62 is cammed inward toward the fixed barb 46*a*. After sufficient longitudinal movement between the release pin 70 and the inner coupling part 40, the two barbs 46*a* and 46*b* move past the second, end surface 30 and out of the central opening 26 of the outer coupling part 20. This movement releases the flexible arm 62 to spring outward, and as a result the two barbs 46*a* and 46*b* spread apart from each other, lightly engaging the end surface 30. At the same time, the garment tab 50 on the inner coupling part 40 extends outward through the first slot 34 on the outer coupling part 20.

Figure 7:
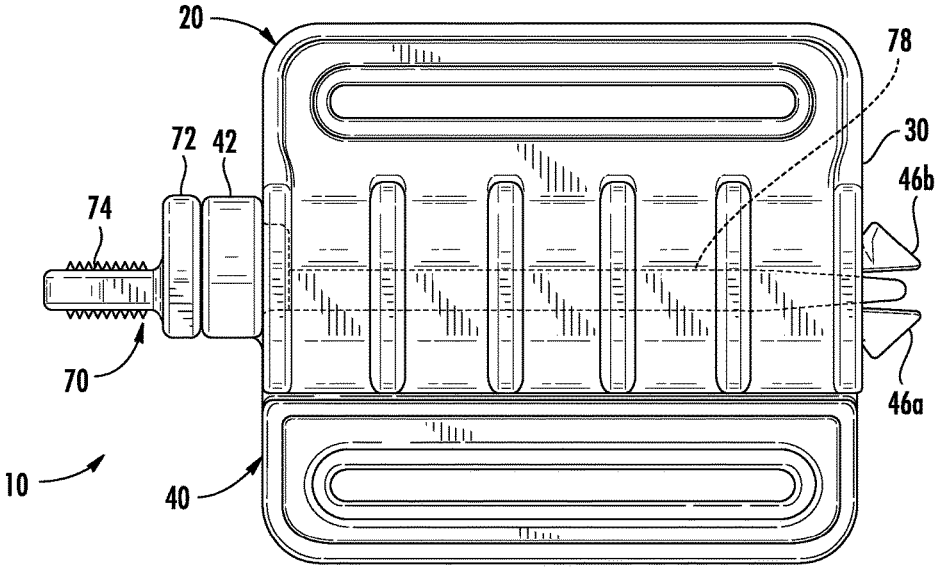
FIG. 7 is a view similar to FIG. 6 showing the entire coupling in a locked condition.
Figure 8:
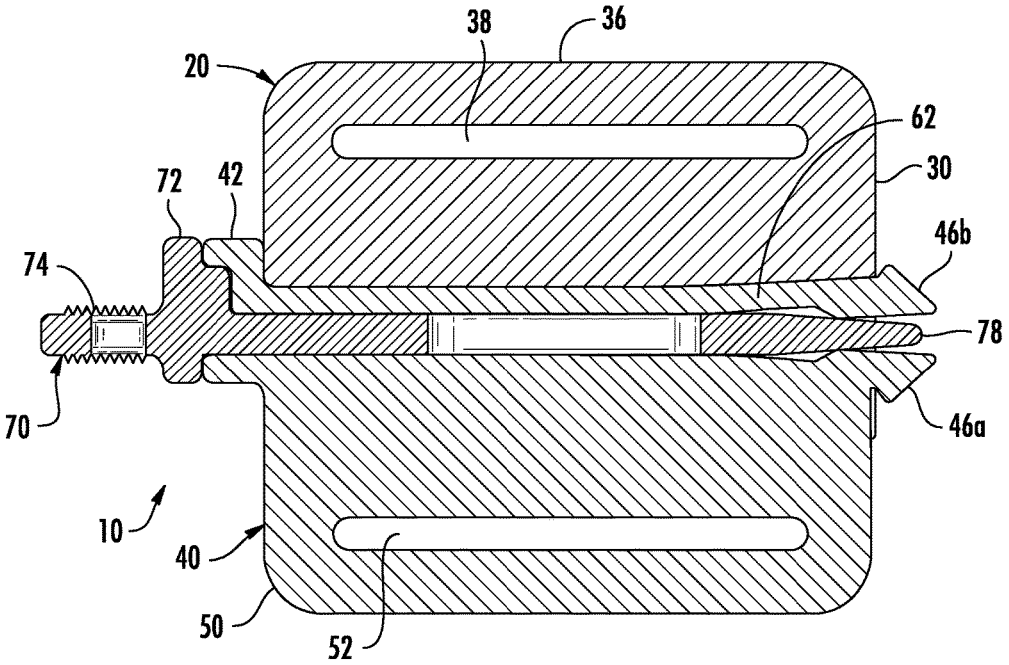
FIG. 8 is a sectional view showing the entire coupling in a locked condition.

The release pin 70 is then pushed in relative to the inner coupling part 40 and the outer coupling part 20, to the locked position (FIG. 7). Both pairs of detent 84 and 86 teeth enter into the pin passage 64. As this movement occurs, the tapered outer end portion 78 of the release pin 70 moves to a position between the flexible arm 62 and the fixed arm portion 44 of the inner coupling part 40. The presence of the release pin 70 blocks movement of the movable barb 46*b*, on the flexible arm 62, toward the fixed barb 46*a*. As a result, the spacing between the two barbs 46*a* and 46*b* cannot be reduced enough to allow the two barbs to disengage from the second end surface 30 of the outer coupling part 20. Therefore, the inner coupling part 40 cannot be moved out of engagement with the outer coupling part 20, the two coupling parts are secured to each other, and the two garment parts 12 and 14 are secured to each other.

To release the coupling 10 from this locked condition, the pull tab 74 on the release pin 70 is grasped and the release pin 70 is pulled out of the assembly of the two coupling parts 20 and 40. The first detent 84 on the release pin 70 move into the detent openings 58. The detent teeth 86 on the release pin 70 engage the end surface 60 on the inner coupling part 40, thus keeping the two parts 40 and 70 together and allowing them to be pulled out together from the outer coupling part 20 with one motion.

At the same time, the tapered end portion 76 of the release pin 70 is withdrawn from its position between the two barbs 46*a* and 46*b*, allowing the movable barb 46*a* to be moved inward toward the fixed barb 46*b*. The inner coupling part 40 can then be removed from the outer coupling part 20. Further pulling force on the release pin 70 causes the release pin 70 to pull the inner coupling part 40 out of the outer coupling part 20. The coupling 10 as a whole becomes disconnected, and the two garment parts 12 and 14 can be moved relative to each other (separated).

From the foregoing description of an embodiment of the invention, those of ordinary skill in the art to which the invention pertains will see variations and modifications of the invention. Such variations and modifications are intended to be covered by the appended claims.

The invention claimed is:

1. A quick disconnect coupling for releasably connecting first and second garment parts, the coupling including:

a tubular outer coupling part having a longitudinally extending central opening and having a garment connector portion that is configured to be connected with the first garment part;

an inner coupling part having a garment connector portion that is configured to be connected with the second garment part, the inner coupling part being movable longitudinally into the central opening of the outer coupling part; and a release pin that is movable longitudinally along a pin passage in the inner coupling part when the inner coupling part is in the central opening of the outer coupling part, to change the configuration of the inner coupling part from a locked condition in locking engagement with the outer coupling part to an unlocked configuration in which the inner coupling part can be pulled out of the central opening of the outer coupling part thereby to disconnect the coupling;

wherein the movement of the inner coupling part from the locked condition to the unlocked condition comprises relative movement of two locking members on the inner coupling part toward each other.

2. A coupling as set forth in claim 1 wherein the locking members are barbs on the inner coupling part that when moved apart from each other engage the outer coupling part to thereby block disengagement of the inner coupling part from the outer coupling part, and that when allowed to move toward each other allow disengagement of the inner coupling part from the outer coupling part.

3. A quick disconnect coupling for releasably connecting first and second garment parts, the coupling including:

a tubular outer coupling part having a longitudinally extending central opening and having a garment connector portion that is configured to be connected with the first garment part;

an inner coupling part having a garment connector portion that is configured to be connected with the second garment part, the inner coupling part being movable longitudinally into the central opening of the outer coupling part; and a release pin that is movable longitudinally along a pin passage in the inner coupling part when the inner coupling part is in the central opening of the outer coupling part, to change the configuration of the inner coupling part from a locked condition in locking engagement with the outer coupling part to an unlocked configuration in which the inner coupling part can be pulled out of the central opening of the outer coupling part thereby to disconnect the coupling;

wherein movement of the inner coupling part to the locked condition comprises expansion of the inner coupling part by the release pin within the central opening of the outer coupling part.

4. A quick disconnect coupling for releasably connecting first and second garment parts, the coupling including:

a tubular outer coupling part having a longitudinally extending central opening and having a garment connector portion that is configured to be connected with the first garment part;

an inner coupling part having a garment connector portion that is configured to be connected with the second garment part, the inner coupling part being movable longitudinally into the central opening of the outer coupling part; and a release pin that is movable longitudinally along a pin passage in the inner coupling part when the inner coupling part is in the central opening of the outer coupling part, to change the configuration of the inner coupling part from a locked condition in locking engagement with the outer coupling part to an unlocked configuration in which the inner coupling part can be pulled out of the central opening of the outer coupling part thereby to disconnect the coupling;

wherein the inner coupling part has a movable barb and a fixed barb that are located longitudinally outside the central opening of the outer coupling part when in the locked condition, the release pin being movable longitudinally along a pin passage of the inner coupling part into a position between the movable barb and the fixed barb to separate the movable barb from the fixed barb to prevent the inner coupling part from being withdrawn from the central opening of the outer coupling part.

5. A quick disconnect coupling for releasably connecting first and second garment parts, the coupling including:

a first coupling part configured to be connected with the first garment part;

a second coupling part configured to be connected with the second garment part and being releasably connectable with the first coupling part to releasably connect the first and second garment parts; and a third coupling part that engages the second coupling part and that moves the second coupling part between a locked condition in which it cannot be disconnected from the first coupling part and an unlocked condition in which the second coupling part can be disconnected from the first coupling part to disconnect the coupling;

wherein the third coupling part is a release pin that is manually movable relative to the inner coupling part in a manner so as to enlarge the inner coupling part to a size in which the inner coupling part cannot be removed from the outer coupling part.

6. A quick disconnect coupling for releasably connecting first and second garment parts, the coupling including:

a first coupling part configured to be connected with the first garment part;

a second coupling part configured to be connected with the second garment part and being releasably connectable with the first coupling part to releasably connect the first and second garment parts; and a third coupling part that engages the second coupling part and that moves the second coupling part between a locked condition in which it cannot be disconnected from the first coupling part and an unlocked condition in which the second coupling part can be disconnected from the first coupling part to disconnect the coupling;

wherein the third coupling part is a release pin that is manually movable relative to the inner coupling part thereby changing the configuration of the inner part between the locked condition and the unlocked condition.

7. A quick disconnect coupling for releasably connecting first and second garment parts, the coupling including:

an outer coupling part having an elongate tubular side wall centered on a longitudinal axis of the coupling, the side wall defining a longitudinally extending central opening within the side wall, the outer coupling part further including a garment connector portion that is configured to be connected with the first garment part;

an inner coupling part having a garment connector portion that is configured to be connected with the second garment part, the inner coupling part further including an elongate tubular wall segment that is movable axially into and within the central opening of the outer coupling part, the tubular wall segment defining an elongate pin passage inside the tubular wall segment that extends axially the length of the tubular wall segment; and an elongate release pin that is movable axially into and within the pin passage in the inner coupling part when the inner coupling part is in the central opening of the outer coupling part, between a first position in which the release pin forces the inner coupling part into a locked condition in locking engagement with the outer coupling part, and a second position in which the release pin allows the inner coupling part to move to an unlocked condition out of locking engagement with the outer coupling part thereby enabling the inner coupling part to be pulled out of the central opening of the outer coupling part thereby to disconnect the coupling.

8. A coupling as set forth in claim 7 wherein the movement of the inner coupling part from the locked condition to the unlocked condition comprises relative movement of two locking members on the inner coupling part toward each other.

9. A coupling as set forth in claim 8 wherein the locking members are barbs on the inner coupling part that when moved apart from each other engage the outer coupling part to thereby block disengagement of the inner coupling part from the outer coupling part, and that when allowed to move toward each other allow disengagement of the inner coupling part from the outer coupling part.

10. A coupling as set forth in claim 7 wherein movement of the inner coupling part to the locked condition comprises expansion of the inner coupling part by the release pin within the central opening of the outer coupling part.

11. A coupling as set forth in claim 7, wherein the inner coupling part has a movable barb and a fixed barb that are located axially outside the central opening of the outer coupling part when in the locked condition, the release pin being movable axially along a pin passage of the inner coupling part into a position between the movable barb and the fixed barb to separate the movable barb from the fixed barb to prevent the inner coupling part from being withdrawn from the central opening of the outer coupling part.

* * * * *